United States Patent [19]

Dembicks

[11] 4,371,079

[45] Feb. 1, 1983

[54] CONTAINER FOR CHAIN SAWS

[75] Inventor: Andrew E. Dembicks, Raleigh, N.C.

[73] Assignee: Southern Case, Inc., Raleigh, N.C.

[21] Appl. No.: 277,237

[22] Filed: Jun. 25, 1981

[51] Int. Cl.[3] ..... B25H 3/02; B65D 6/00

[52] U.S. Cl. ..... 206/349

[58] Field of Search ..... 206/317, 320, 314, 521, 206/576, 577, 588, 14, 482, 315 R, 349; 30/151, 381; 273/74; 150/52 G

[56] References Cited

U.S. PATENT DOCUMENTS

| | | | |
|---|---|---|---|
| 2,376,887 | 5/1945 | Walters | 30/151 |
| 3,042,087 | 7/1962 | Otoupalik | 30/151 |
| 3,129,731 | 4/1964 | Tyrrell | 30/151 |
| 3,344,818 | 10/1967 | Musgrove | 30/151 |
| 3,371,975 | 3/1968 | Meltzer | 206/349 |
| 3,641,697 | 2/1972 | Heidtman et al. | 206/315 |
| 4,162,004 | 7/1979 | Thomas | 206/317 |
| 4,252,239 | 2/1981 | Snyder | 206/349 |

FOREIGN PATENT DOCUMENTS

| | | | |
|---|---|---|---|
| 96880 | 7/1897 | Fed. Rep. of Germany | 224/232 |
| 2713752 | 10/1978 | Fed. Rep. of Germany | 30/151 |

*Primary Examiner*—William Price
*Assistant Examiner*—Jimmy G. Foster

[57] ABSTRACT

This invention is a container designed for use in conjunction with elongated products such as chain saws. These containers can be shipped in space saving knocked-down or partially assembled condition and yet can quickly and easily be assembled to give the appearance and rigidity of a pre-formed container.

9 Claims, 5 Drawing Figures

CONTAINER FOR CHAIN SAWS

FIELD OF INVENTION

This invention relates to containers and more particularly to knocked-down containers for chain saws and similar products.

BACKGROUND OF INVENTION

Since the development of chain saws, these devices have been primarily used in the logging and tree trimming industries. Substantial improvements, have been made in this type of equipment in recent years which have made them appealing to noncommercial purchasers.

With the present fossil fuel shortages and the spiraling cost of cord wood for use in stoves and fireplaces, a tremendous demand has been created for chain saws and related equipment. Since these saws are stored quite often over an extended period of time during the off season as well as being transported in vehicles not specifically designed for this purpose, the providing of containers to both protect the saw and prevent it from the snagging on surrounding items have been developed.

These containers have been in the form of everything from relatively heavy, bulky boxes to molded plastic cases generally conforming to the exterior shape of the saw. The box like containers, of course, are heavy and bulky and generally undesirable, particularly for noncommercial usage. The contoured cases on the other hand, although space saving as compared to box like containers, still require an unusually large amount of space, especially when shipped from the manufacturing plant to the consumer outlet. Because of this "shipping of air", transportation cost of the prior art cases or containers are unusually high. Due to the unsymmetrical configuration of the chain saw, nesting of case parts for shipment as well as other breakdowns of the same have not been deemed impractical. Other attempts at reducing shipping costs of these containers have been made but to the present have not provided a practical solution to the problem.

BRIEF DESCRIPTION OF INVENTION

After much research and study into the above-mentioned problems, the present invention has been developed to provide a contoured container for chain saws and the like which gives a unitary appearance in sight and feel and yet is so designed as to be shipped with the scabbard portion nestled within the engine portion of the case. This is accomplished through the use of uniquely designed interlocking wall sections with a snap-in projection for retention of the assembled portions. Because of the unique features of this container, the same can be shipped in much less space than ordinary containers of this general type and yet when assembled, serves the same function as the unitary container of the prior art.

In view of the above, it is an object of the present invention to provide a chain saw type container which can be shipped in partially knocked-down condition and yet can readily be assembled for use.

Another object of the present invention is to provide a chain saw container which can be shipped in unassembled condition and yet when assembled has the appearance and strength of a pre-formed unit.

Another object of the present invention is to provide interlocking wall portions with a securing pin for permanently connecting the sections of a container together.

Another object of the present invention is to provide a chain saw type container which is easily shipped and yet sturdy in assembled condition.

Another object of the present invention is to provide a blow molded double walled chain saw carrying case which is assembled through the use of reverse draft and interface fits.

Another object of the present invention is to provide a chain saw carrying case which is molded in three pieces including a lid, a base, and a scabbard section wherein, when assembled, the scabbard section is permanently attached to the base section.

Another object of the present invention is to provide a compression molded pin for permanently anchoring the scabbard section of a blow molded, double-walled carrying case to the base section thereof.

Another object of the present invention is to provide, in a chain saw type carrying case, a rear section which is lowered through a stepped parting line to allow a chain saw type tool to be more easily loaded into the case without binding or other interference.

Other objects and advantages of the present invention will become apparent and obvious from a study of the following description and the accompanying drawings which are merely illustrative of such invention.

DETAILED DESCRIPTION OF INVENTION

Figure 1:
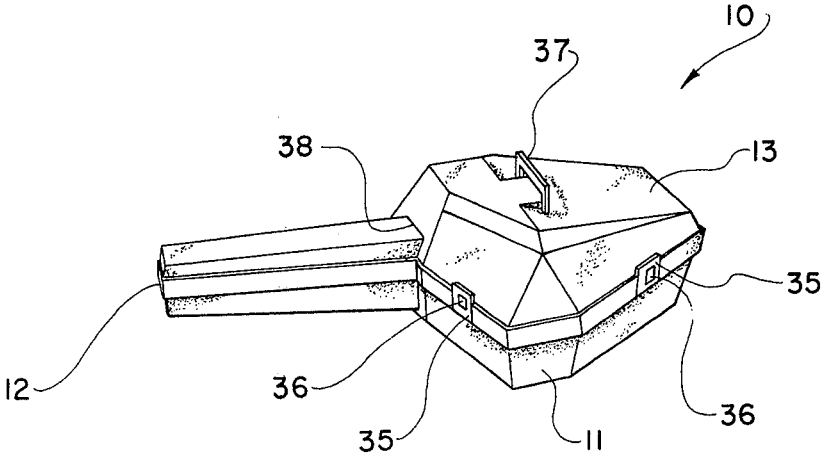
FIG. 1 is a perspective view of the container of the present invention.

With further reference to the drawings, the container of the present invention, indicated generally at 10, includes a base portion 11, a mating scabbard portion 12 and a pivoted lid portion 13. Both the base and lid portions are preferably of the blow molded, double walled type. These portions are assembled through use of an interlocking pin 14 so as to pivot along hinge line 15.

Side walls 16 and 17 and bottom 18 of base portion 11 are all of normal double walled thickness. The front or scabbard wall 19 angles out into a thickness several times that of walls 16 and 17 which can clearly be seen in FIGS. 2 and 3.

A generally U-shaped opening 20 is provided in front wall 19. This opening is bounded by a generally flat bottom area 21 with adjacent generally flat sloping areas 22. A generally triangular shaped indention 23 bounded by shoulders 24 forms the side areas of opening 20. An opening 25 is provided in the bottom area 21 of opening 20 and is adapted to retainingly receive anchoring pin 26 as will hereinafter be described in more detail.

A rather hefty, triangular-in-cross-section retaining projection 27 is provided on opposed sides 28 of scabbard portion 12. Each of these projections are so sized as to snugly mate with their respective triangular shaped indention 23 in base portion 11. When in such mated position, shoulders 24 will lie juxtaposed to a portion of the respective side 28 of scabbard 12. This combination of scabbard projections engaging base indentions and base shoulders engaging scabbard sides give a firm interlocking action between the base and scabbard portions when in the position shown in FIG. 3.

Figure 3:
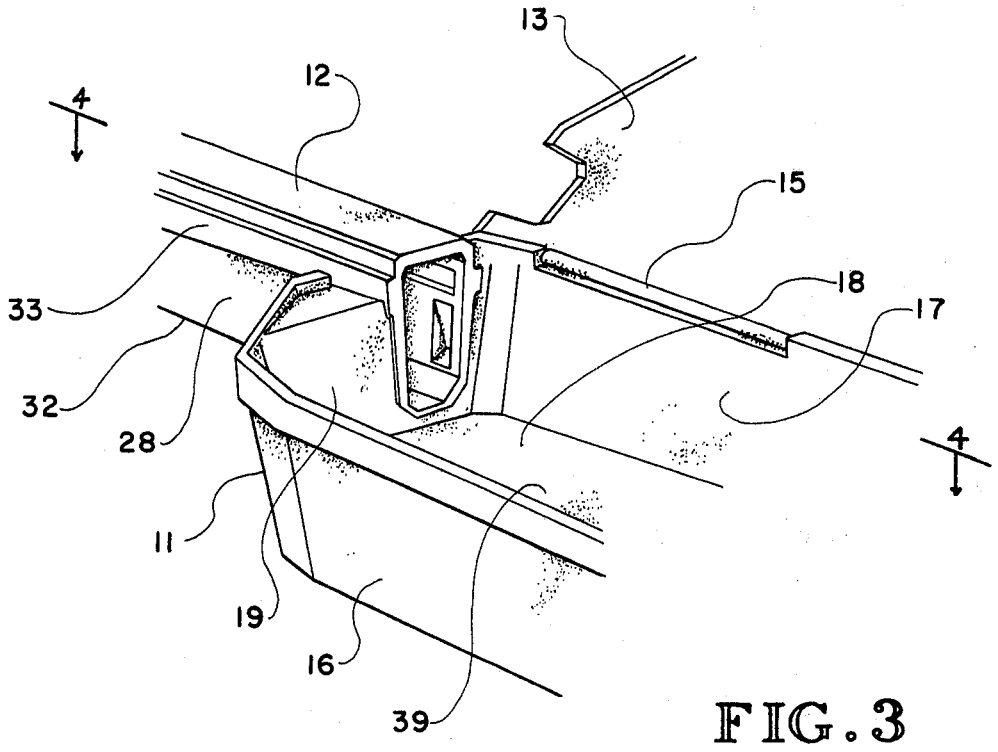
FIG. 3 is a fragmentary view of the scabbard united with the base section.
Figure 4:
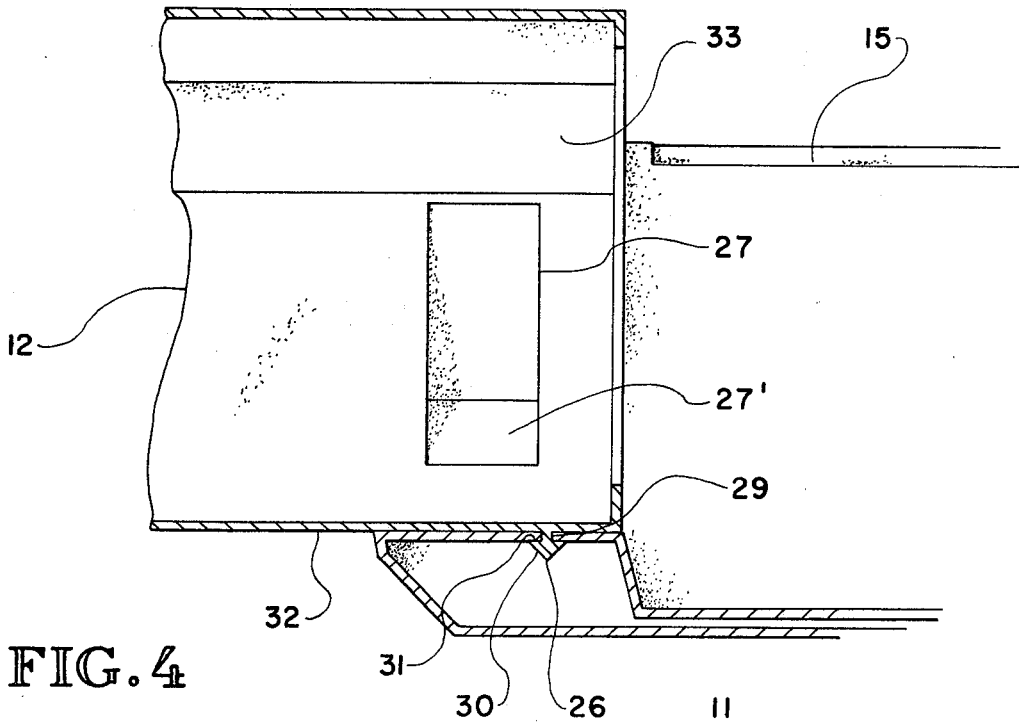
FIG. 4 is a sectional view taken through lines 4—4 of FIG. 3.
Figure 5:
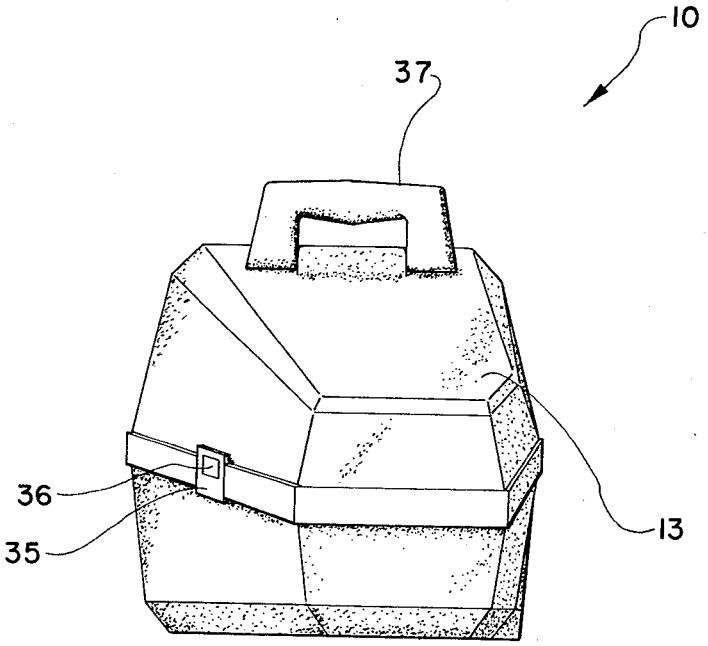
FIG. 5 is an end elevational view of the container of the present invention.

To retain the relationship of the parts as shown in FIG. 3, retaining pin 26 is compression molded onto the lower or bottom portion 32 of scabbard 12 and is in the form of a round or oval shaped shaft 29 with a retaining head 30 formed at the end thereof. The underside of this head forms a shoulder 31 which, when retaining pin 26 is pressed into the opening 25 of the inner wall of the base portion 11, shoulder 31 engages the back side thereof to permanently anchor base portion 11 to scabbard portion 12 as seen clearly in FIG. 4. This is, of course, not done until the container of the present invention is ready to be assembled such as at the time of purchase at a retail outlet. During shipment and storage, the container is, of course, in knocked-down configuration with the scabbard portion 12 being stored inside the cavity formed by the base portion 11 and lid portion 13.

One final comment concerning the interconnection of the base and scabbard portions, the reenforcing rib 33 on each side 28 of the scabbard 12 engage a notch shoulder 34 in the upper side areas of opening 20 of base 11 to give even more rigidity to the relationship of the portions as can clearly be seen in FIG. 3.

Snap latches 35 are provided on lid portion 13 for engaging corresponding locking shoulders 36 of base portion 11. Also a handle 37 is provided with lid portion 13 to allow the assembled container 10 to be easily picked up and transported.

Lid portion 13 also includes a notched area 38. When the assembled container 10 is in the closed position shown in FIG. 1, the notched area 38 will add even more rigidity to the relationship of the assembled parts.

Since the portions of the present invention are preferably formed from a semi-rigid material such as blow molded plastic, the sides of opening 20 can be distorted outwardly while the scabbard walls 28 can be distorted inwardly during the assembling process.

The base and lid portions 11 and 13 of the container 10 of the present invention are double walled and formed by blow molding. These two portions are then assembled at the hinge areas as above-described so that when the portions are closed, they form an interior area 39. The scabbard portion 12 is formed preferably as a single wall unit since it does not need to be aesthetically appealing on the interior as it is adapted to receive a projecting portion of the article (not shown) placed in the containers such as the cutter bar of a chain saw.

The container of the present invention can either be shipped in partially assembled condition with the lid and base portions connected at the hinge area 15 or they can be shipped separately in nestled form and assembled at the time of first use. In either case, the scabbard portion would be shipped with the container, preferably in the interior 39 of the assembled base and lid portions. Much less space is thus required during shipment thereby allowing more units to be shipped per load. Also during storage, prior to final assembly and use, much less valuable storage area is required for any given number of units than if the same were completely assembled.

Figure 2:
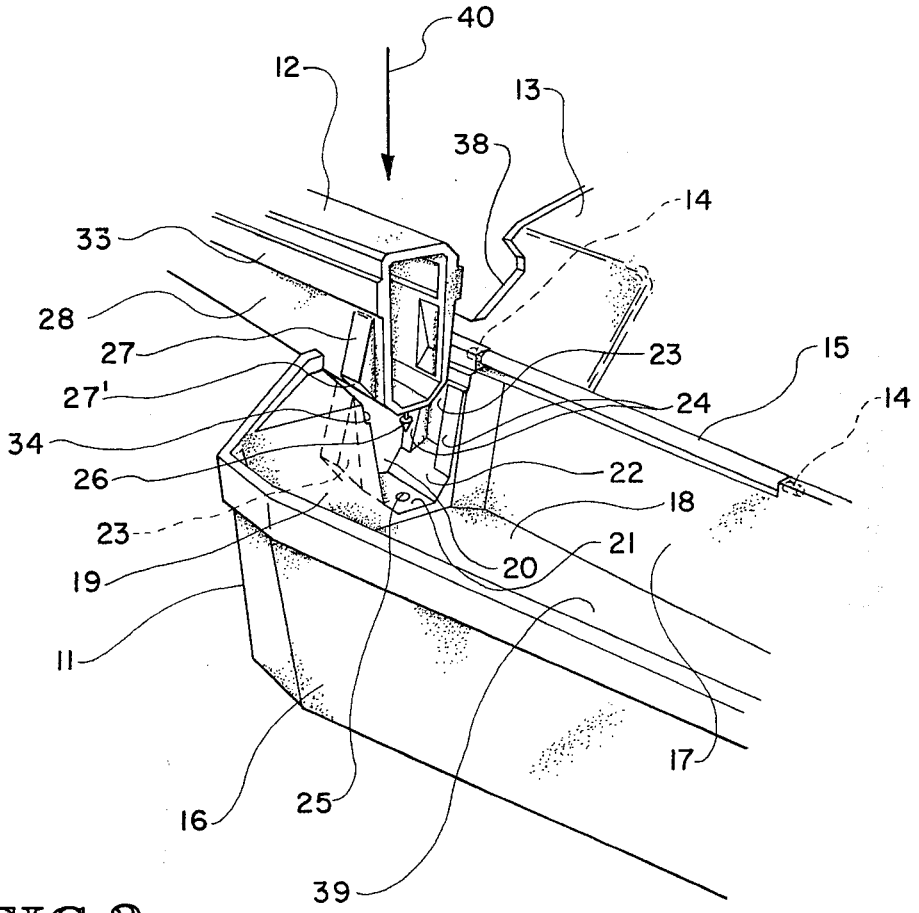
FIG. 2 is an exploded fragmentary view of the scabbard to base interlocking means.

Once it is desired to use the container of the present invention, the scabbard 12 is placed in the position shown in FIG. 2 and pressure is applied in the direction of arrow 40. The flat, generally beveled side 27' of projection 27 slidingly engages the upper edges of opening 20. Although double walled blow molded plastic articles are relatively rigid, there is some give inherent in the product. This give allows the same to be able to withstand impacts without breaking and, in the present case, allows the outer portions of opening 20 to be distorted outwardly and the sides 28 of the scabbard 12 to be distorted inwardly as the beveled portions 27' of projections 27 slide downwardly with the scabbard 12 into said opening 20. As the scabbard retaining projections 27 matingly enter indention areas 23 of base 11, the adjacent portions return to their normal undistorted positions with a snug fit being accomplished as shown in FIG. 3.

The final assembly is the use of a blount instrument such as a hammer handle pressing down on the interior of scabbard 12 above anchor pin 26 to form the same into opening 25 in the inner wall of base 11. Once the retaining head 30 has passed through the opening, the shoulder portion 31 will engage the underside of such inner portion thus permanently retaining the scabbard portion 12 relative to the base portion 11 as clearly seen in FIG. 4.

The rear portion of the container of the present invention opposite scabbard 12 is inclined as indicated at 42 to allow a chain saw or other article to readily be placed within the container. As can clearly be seen in FIG. 3, side 16 is distinctly lower than side 17 thus allowing for the end configuration to be readily formed.

Equipment such as a chain saw can then be placed in the container 10 with cutter bar of the saw extending into the scabbard of the container and the engine being disposed interiorly of the base and lid portions 11 and 13. Container 10 can then be closed, pivoting about hinge 15 with latches 35 engaging shoulders 36. The container and its product is then ready for storage, transport or the like.

From the above, it can be seen that the present invention has the advantage of providing a highly efficient interlocking system between the scabbard and base portions of a chain saw type container and yet provides a means for shipping and storing such container in space saving, knocked-down condition. Once the scabbard and base portions are snapped together (without the use of separate securing means), the same becomes an integral unit permanently connected together.

The terms "upper", "lower", "bottom", "top", "front" and so forth are used herein merely for convenience to describe the container and its parts as oriented in the drawings. It is understood, however, that these terms are in no way limiting to the invention since the container may obviously be disposed in many different positions when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A container comprising a base portion including at least one wall, a generally U-shaped opening in said wall bordered by side areas and a bottom area; a recess in at least one of said side areas; a scabbard portion having side walls and a bottom; and a projection outwardly disposed from at least one of said scabbard sides, said projection being so sized as to matingly engage said recess in said side area whereby said scabbard portion can be assembled into said base portion in a relatively rigid relationship.

2. The container of claim 1 wherein an anchor means is provided for permanently securing said scabbard portion to said base portion.

3. The container of claim 2 wherein said anchor means is in the form of a pin means projecting from the bottom of said scabbard and having an enlarged head thereon for lockingly engaging an opening formed in the bottom area of said generally U-shaped opening.

4. The container of claim 3 wherein said pin is integrally molded with said scabbard portion.

5. The container of claim 1 wherein a lid portion is hingedly connected to said base portion.

6. The container of claim 5 wherein said lid portion includes hinge means having cooperating portions that are integrally molded into the base and lid portions.

7. The container of claim 5 wherein said lid portion is so configured to grippingly engage said scabbard portion when said lid is in a closed position relative to said base portion.

8. The container of claim 1 wherein said portions of said container are of the double walled, blow mold formed type.

9. The container of claim 1 wherein an end portion of said container opposite said scabbard is undercut whereby a chain saw type article can be readily loaded thereinto.

* * * * *